US011098508B2

(12) United States Patent
Schiffer

(10) Patent No.: US 11,098,508 B2
(45) Date of Patent: Aug. 24, 2021

(54) MOTOR VEHICLE LOCK

(71) Applicant: Kiekert AG, Heiligenhaus (DE)

(72) Inventor: Holger Schiffer, Meerbusch (DE)

(73) Assignee: Kiekert AG, Heiligenhaus (DE)

( * ) Notice: Subject to any disclaimer, the term of this patent is extended or adjusted under 35 U.S.C. 154(b) by 519 days.

(21) Appl. No.: 15/741,511

(22) PCT Filed: Jun. 30, 2016

(86) PCT No.: PCT/DE2016/100293
§ 371 (c)(1),
(2) Date: Jan. 3, 2018

(87) PCT Pub. No.: WO2017/005244
PCT Pub. Date: Jan. 12, 2017

(65) Prior Publication Data

US 2018/0195322 A1 Jul. 12, 2018

(30) Foreign Application Priority Data

Jul. 3, 2015 (DE) ..... 10 2015 110 751.1

(51) Int. Cl.
*E05B 85/26* (2014.01)
*E05B 81/14* (2014.01)
(Continued)

(52) U.S. Cl.
CPC ..... *E05B 85/26* (2013.01); *E05B 81/15* (2013.01); *E05B 81/66* (2013.01); *E05B 81/68* (2013.01); *E05B 85/243* (2013.01)

(58) Field of Classification Search
CPC ..... E05B 81/06; E05B 81/15; E05B 81/34; E05B 81/66; E05B 81/68; E05B 85/243;
(Continued)

(56) References Cited

U.S. PATENT DOCUMENTS

2005/0040658 A1* 2/2005 Larsen ..... E05B 83/16 292/229
2005/0280265 A1* 12/2005 Iliescu ..... E05B 81/14 292/216
(Continued)

FOREIGN PATENT DOCUMENTS

DE 10361168 A1 7/2005
DE 10 2006 032033 A1 3/2007
(Continued)

OTHER PUBLICATIONS

Computer Generated Translation for DE102006032033, Generated on Apr. 8, 2020, https://worldwide.espacenet.com/ (Year: 2020).*
(Continued)

*Primary Examiner* — Alyson M Merlino
(74) *Attorney, Agent, or Firm* — Renner, Otto, Boisselle & Sklar, LLP

(57) ABSTRACT

The invention relates to a motor vehicle lock (1) comprising a locking mechanism that includes a rotary latch (2), at least one pawl (3), a triggering lever (4) that allows the pawl (3) to disengage from the rotary latch (2), and a latching lever function that allows the triggering lever (4) which is actuated for disengaging the rotary latch (2) to be secured in an actuated position; the triggering lever can be guided by the rotary latch (2) only in some sections.

10 Claims, 4 Drawing Sheets

(51) Int. Cl.
*E05B 81/68* (2014.01)
*E05B 85/24* (2014.01)
*E05B 81/66* (2014.01)

(58) Field of Classification Search
CPC ..... E05B 85/26; E05B 83/18; E05B 83/24; E05B 83/16; E05B 77/16; Y10T 292/1047; Y10T 292/108; Y10T 292/1082; Y10S 292/16; Y10S 292/61; Y10S 292/23
See application file for complete search history.

(56) References Cited

U.S. PATENT DOCUMENTS

2006/0279090 A1* 12/2006 Ottino ..... E05B 85/26 292/216
2010/0171320 A1* 7/2010 Gumbo ..... E05B 81/14 292/200
2012/0061977 A1* 3/2012 Takeda ..... E05B 81/20 292/201
2012/0274084 A1* 11/2012 Rosales ..... E05B 81/14 292/196
2014/0252783 A1* 9/2014 Yokota ..... E05B 81/34 292/196
2015/0048629 A1* 2/2015 Saravia Terricabras ..... E05B 81/15 292/194
2015/0267441 A1* 9/2015 Fuchs ..... E05B 85/26 292/200
2015/0308161 A1* 10/2015 Rosales ..... E05B 85/26 292/195
2015/0308165 A1* 10/2015 Scholz ..... E05B 85/26 292/199
2017/0159334 A1* 6/2017 Ishiguro ..... E05B 81/15

FOREIGN PATENT DOCUMENTS

DE 20 2011 100643 U1 8/2012
DE 102012017677 A1 3/2014
DE 102016107509 A1 * 10/2017 ..... E05B 85/26
EP 0978610 B1 5/2003
EP 2 829 675 A1 1/2015
WO 2015/062578 A2 5/2015

OTHER PUBLICATIONS

International Search Report for corresponding Patent Application No. PCT/DE2016/100293 dated Oct. 13, 2016.

* cited by examiner

MOTOR VEHICLE LOCK

FIELD OF THE INVENTION

The invention relates to a motor vehicle latch having a locking mechanism with a catch and at least one pawl, a triggering lever, whereby by means of the triggering lever the pawl can be disengaged from the catch, a storage lever function, whereby by means of the storage lever function a triggering lever activated to disengage the catch can be fixed in an activated position.

BACKGROUND OF THE INVENTION

In order to increase functional safety in motor vehicles, the motor vehicle latches used in the flaps, doors, sliding doors or hoods are equipped with a multitude of functions. One of these functions is that relatching or incomplete opening is prevented also in the case of opening of a locking mechanism in a motor vehicle latch.

In particular where the latch is a tailgate latch, it is possible that after electrical or manual opening of the latch the locking mechanism remains in the engagement area of the latch holder as the flap is acted upon with a heavy load, in particular a snow load. In this case, the catch engaged with the latch holder cannot completely leave the engagement area of the pawl or pivot out of the engagement area of the pawl so that there is a risk of the pawl re-engaging with the catch. To prevent the pawl re-engaging with the catch after unlocking of the locking mechanism, the snow load function can be integrated into a motor vehicle latch. The pawl disengaged during the opening process is held in a position in which the pawl cannot re-engage with the catch. Maintaining the pawl in a disengaged position is described as a storage lever function or a snow load function.

From DE 10 2013 018 451.7, a motor vehicle latch and in particular a tailgate latch has become known that is equipped with a storage lever function. In a locking mechanism consisting of a catch and a pawl, a triggering lever is provided for in which a tappet contour is provided for with which the pawl can be disengaged from the catch. The known motor vehicle latch is an electrically activated latch, whereby the triggering lever is activated via a cam disk. The triggering lever and the pawl are pivotably accommodated by means of a common axis so that the triggering lever can pivot the pawl by means of the tappet contour.

In order to form the storage function, a storage lever molded to the housing of the motor vehicle latch is provided for which interacts with a protrusion of the triggering lever so that the triggering lever is held in its deflected position, the opening position, in the deflected or opening position. i.e. after pivoting of the triggering lever and thus disengagement of the pawl from the catch the triggering lever is fixed in its position or held in its position by the interplay of the protrusion on the triggering lever with the storage lever.

By means of the tappet contour, the pawl is simultaneously maintained in a position which prevents re-engagement with the catch. Should the catch not be completely opened in this case and possess a pre-ratchet position, for example, the storage function prevents the pawl engaging with the main ratchet or pre-ratchet of the catch. Only when the catch has been completely opened does a triggering contour on the catch engage with the storage lever and release the triggering lever, whereby the triggering lever and the pawl can be moved back into their starting position or become engaged and adjacent to the catch. i.e. the triggering lever and the pawl are adjacent to the catch. The becoming adjacent occurs by means of spring pre-tensioning.

A further motor vehicle latch has become known from DE 103 61 168 A 1. The described motor vehicle latch also encompasses a storage lever function, whereby a spring arm interacts with a ratchet connecting element with a ratchet connecting counterelement in such a way that a pawl can be maintained in a disengaged state with the catch. The ratchet connecting element is molded to the drive arm and interacts with a contour, the ratchet connecting counter element on the catch. The ratchet connecting element and the ratchet connecting counterelement are configured in such a way that they engage when the locking mechanism is opened and conduct the pawl via the main ratchet position and a pre-ratchet position. The ratchet connecting element and the ratchet connecting counterelement are only disengaged again in the completely open state. The ratchet connecting element and the ratchet connecting counterelement are thus detached from one another in the completely open state and the pawl lies adjacent to the catch in a spring pre-tensioned manner.

A problem which can arise on motor vehicle latches with a storage function is that when the locking mechanism is locked the pawl and/or the triggering lever can be conducted by means of the catch and, according to the activation speed of the catch, can experience an impulse during closure by the catch. The triggering lever and/or the pawl are usually adjacent to the catch and are conducted by the catch in a spring pre-tensioned manner. If the catch accelerates too greatly during closure, this can lead to the pawl and/or the triggering lever being acted on with an impulse or force in such a way that the pawl and/or the triggering lever can reach the storage lever function. In this case, locking of the locking mechanism by the storage lever function is prevented.

SUMMARY OF THE INVENTION

The task of the invention is to provide an improved motor vehicle latch. In particular, it is a task of the invention to increase the functional safety of motor vehicle latches and to guarantee engagement of the locking mechanism functions at any time with the greatest level of safety. Furthermore, it is a task of the invention to provide a cost-effective motor vehicle latch of a simple construction.

The task is solved according to the invention by the characteristics of the latch described herein. Advantageous embodiments of the invention are also described herein. It is pointed out that the exemplary embodiments described hereafter are not restrictive; instead, any possible variations are possible of the characteristics described in the description.

The task of the invention is solved by a motor vehicle latch being provided, having a locking mechanism with a catch and at least one pawl, a triggering lever, whereby by means of the triggering lever the pawl can be disengaged from the catch, a storage lever function, whereby by means of the storage lever function a triggering lever activated to disengage the catch can be fixed in an activated position and whereby the triggering lever can only partly be conducted by the catch. Due to the fact that the triggering lever can only be conducted by the catch in places, this now creates the possibility of the triggering lever being securely held in all positions of the catch in an adjacent position on the catch. An unintentional movement of the triggering lever by rapid activation by means of the catch, for example, can thus be controlled in a targeted manner, i.e. the triggering lever is only conducted in the area by means of the catch which is necessary for the function of the triggering lever.

The motor vehicle latch according to the invention has a locking mechanism with a catch and at least one pawl. The catch and the pawl thus interact in such a way that the pawl fixes the catch in a position in which the catch has been moved by means of a latch holder, for example. The motor vehicle latch and thus the catch can be mounted in a door of a motor vehicle latch, a tailgate, a sliding door, a storage compartment, a rear seat bench or a hood and interact with a latch holder or a latch holder bracket attached onto the chassis, for example. If the motor vehicle latch is installed in a tailgate of a motor vehicle, for example, and if a latch holder is located on the chassis, the catch can thus be engaged with the latch holder by closure of the tailgate. The locking mechanism preferably has two closure positions, a pre-ratchet position and a main ratchet position. In the closure position into which the catch reaches by closure of the tailgate, the catch is fixed in position by means of the pawl, i.e. locked. The locking mechanism can have one, two or more pawls which interact with the catch in one or several planes.

Furthermore, the motor vehicle latch has a triggering lever, whereby by means of the triggering lever the pawl or the pawls can be disengaged with the catch. The triggering lever engages on the pawl and moves the pawl into an area which is outside of a pivoting area of the catch. The catch is thus able to reach an opening position by means of a spring pre-tensioning and/or sealing pressure of the flap or door. The door or flap can then be completely opened in the opening position.

Furthermore, if the motor vehicle latch has a storage lever function, the pawl is held in a disengaged position with the catch by means of the triggering lever. This can be necessary in particular if, as described above, a snow load acts on a tailgate, for example, and the flap cannot be completely opened. An operator of the motor vehicle is then able to open the flap, although the pawl is located in a position in which it would be able to engage a pre-ratchet of the catch, for example, in relation to the rotational angle of the catch. The triggering lever and in particular the storage lever function keeps the pawl disengaged with the catch until the catch is moved into the completely open position, i.e. the opening position. For example, this can occur by an operator manually opening the tailgate. In a completely open position of the catch, the storage lever function is deactivated so that the pawl and the triggering lever become adjacent to the catch again.

If the catch is in the opening position, the pawl and the triggering lever are thus adjacent to the catch and are conducted by means of the catch. The triggering lever is only partly conducted by the catch according to the invention. The triggering lever is in particular only conducted partly by means of the catch during closure of the locking mechanism. This is in particular advantageous to the extent that the triggering lever cannot be transferred by means of the closure movement of the catch into an undefined position and in particular not into a storage lever position.

In a preferred embodiment of the invention the pawl and the triggering lever are adjacent in an opening position of the motor vehicle latch on the catch. The opening position is the position in which the catch is located if the motor vehicle latch has been completely opened. Advantageously, the catch can be used to control the location of the triggering lever and the pawl. The catch has control contours, preferably superficial contours which interact with the pawl and/or the triggering lever. The control contours can be formed in one plane or different planes on the catch. By means of the formation of control contours on the catch, according to the invention it is possible to define the position of the pawl of the triggering lever, in particular during movement of the catch and in the extreme position of the opening position of the catch.

If the locking mechanism has a pre-ratchet and a main ratchet position, a further embodiment of the invention thus results, whereby the pawl and the triggering lever can be conducted by means of the catch from the opening position to a pre-ratchet position by means of the catch. The locking mechanism preferably has a pre-ratchet position and a main ratchet position. The locking mechanism according to the invention is formed in such a way that the pawl and the triggering lever can be opened by means of the catch from the opening position in which the motor vehicle latch or the tailgate or door can be opened.

Starting from the opening position, the catch is preferably moved by means of a pivoting movement from the opening position into a pre-ratchet position. The pre-ratchet position is the position in which the pawl can be engaged with the catch and the locking mechanism prevents opening of the tailgate, door or flap by means of the engaged pawl. The control contour on the catch conducts the pawl and the triggering lever during the closure movement of the catch so that the pawl and the triggering lever are always located in a defined position. The pawl and the triggering lever are preferably pre-tensioned by a spring and are spring pre-tensioned in respect of the catch.

In a further embodiment of the invention, an advantage is attained if the pawl can be conducted by means of the catch in a main ratchet position and the triggering lever can be maintained in a position assumed during the pre-ratchet position. According to the invention, only the pawl is completely conducted by the catch by means of the catch during the closure movement of the catch. The triggering lever is adjacent on the catch only up to the pre-ratchet position on the catch. In particular, by means of the movement of the catch from the pre-ratchet position to the main ratchet position the triggering lever experiences no further impulse, so that movement of the triggering lever is prevented from reaching an unwanted position after reaching the pre-ratchet position of the catch. An unwanted position would be, for example, one in which the triggering lever is located for example during the storage lever function of the latch. Consequently, the catch conducts the pawl and the triggering lever until attainment of the pre-ratchet position.

After reaching the pre-ratchet position, only the pawl is conducted by means of the catch. During very rapid closure of the catch, for example, this prevents an impulse or a moment being initiated into the triggering lever by means of which the triggering lever is accelerated in such a way that the triggering lever reaches a position in which the storage lever function is activated. After attainment of the pre-ratchet position the triggering lever is preferably held in its position via propulsion means. If the pawl has an extension, whereby by means of the extension at least a switching means can be switched, a further embodiment of the invention thus results. By means of the extension of the pawl, the possibility is now created of detecting holding positions or storage positions of the pawl and/or the catch.

If, for example, the pawl has an extension which acts directly on a switching means, by means of an evaluation of the switching position of the switching means a statement can thus be directly made on the state of the locking mechanism. If, for example, the extension is attached to the pawl in such a way that the switching means activates the switching means on attainment of the pre-ratchet position and/or the main ratchet position, it can thus be detected by means of the switching means whether the locking mechanism is located in a ratchet position. A further function can thus be assumed in the motor vehicle latch by means of the pawl. It is naturally also conceivable that two or more extensions are formed on the pawl which interact with further switching means.

If the triggering lever has a tappet contour and if the pawl can be moved by means of the tappet contour, and can be deflected in particular, a further advantageous embodiment of the invention thus results. By means of a tappet contour on the triggering lever advantageously on the one hand a deflection or movement of the pawl can occur so that the pawl can be disengaged from the catch and simultaneously the possibility exists of conducting the pawl by means of the catch. The triggering lever is able to keep the pawl disengaged from the catch in the case of existence of a storage lever function and on the other hand the pawl can be activated or moved independently of the triggering lever.

In particular after attainment of the pre-ratchet position of the catch and the subsequent independent conducting of the pawl of the triggering lever the pawl can be detached from the triggering lever and be moved independently of the triggering lever. On the one hand, the triggering function can be accomplished by means of the triggering lever and at the same time the storage lever function can be achieved by means of the triggering lever. The triggering lever only takes the pawl along partly and if the triggering lever preferably disengages from the catch to open the locking mechanism.

In a further embodiment of the invention, the pawl and the triggering lever have a common pivoting axis. Due to the formation of a common pivoting axis for the pawl and the triggering lever a compact construction can be advantageously achieved. The tappet and storage lever function can also be executed in a constructionally beneficial manner. In particular, by means of the common axis for the pawl and the triggering lever the combined functions of the pawl as a ratchet and switching element and the triggering lever can be executed as a storage and tappet element in a constructionally beneficial manner. As separate elements, the triggering lever and the pawl thus assume different and multiple functions so that all safety-related functions of the latch can be depicted and, on the other hand, the latch is protected in relation to unwanted functional positions. The partial conducting of the triggering lever during closure of the motor vehicle latch or closure of the locking mechanism serves this purpose in particular.

If the triggering lever can be deflected by means of an electrical drive, in particular by means of an electrically activated control contour, a further advantageous embodiment of the invention results. Activation of the triggering lever by means of an electrical drive and preferably by means of an electrical control contour offers the advantage that in particular in interplay with the switching means detecting the switching positions the position of the latch elements and preferably the latch elements the catch, pawl and triggering lever can be determined at any point. In particular, by means of a control contour on the electrical drive an impact can be had on the triggering moments of the pawl so that the motor vehicle latch is able to be electrically opened at any time.

In a further embodiment of the invention the pawl is at least partly made of metal and partly made of plastic. In order to execute a locking mechanism which can correspond to the greatest tensile stresses, the pawl is preferably executed with a metal core. On the contrary, an extension molded to the pawl is preferably made of plastic, so that a hybrid component is executed which on the one hand fulfills the strength requirements and on the other hand has the advantage of being of a construction which is as light as possible. Furthermore, plastics can be easily molded so that in turn the arrangement of the switching means can be positioned in a constructionally beneficial manner in interplay with the pawl. Furthermore, the metallic part of the pawl can be sheathed with plastic which, on the one hand, has an attenuating effect and, on the other hand, enables beneficial accommodation of the pawl.

In a further embodiment of the invention the triggering lever is made of plastic. The formation of the triggering lever from plastic enables a light component to be formed which can also be easily formed in relation to the multiple functions of the triggering lever from a manufacturing perspective. In particular, surfaces can be formed which are necessary to conduct the triggering lever with the control contour on the catch. Plastics simultaneously offer beneficial frictional ratios between the catch and the triggering lever.

Hereinafter the invention is explained in further detail with reference to the attached drawings on the basis of a preferred embodiment. However, the principle applies that the exemplary embodiment does not restrict the invention but only constitutes an advantageous embodiment. The characteristics depicted can be executed individually or in combination, individually or in combination with other characteristics of the description, as also the patent claims.

BRIEF DESCRIPTION OF THE DRAWINGS

The following are shown.

DETAILED DESCRIPTION

Figure 1:
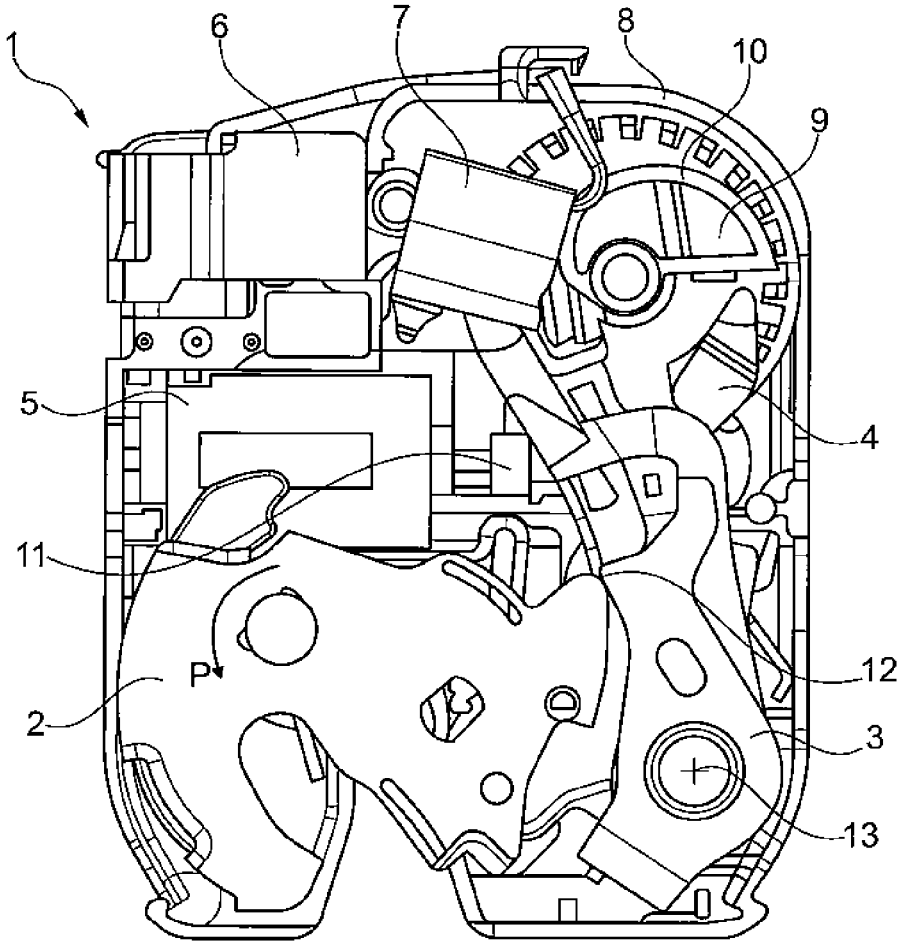
FIG. 1 a top view on a motor vehicle latch, in particular a tailgate latch without a housing lid, whereby the locking mechanism is illustrated in an opening position of the catch, FIG. 2 corresponds to the motor vehicle latch according to FIG. 1, whereby the pre-ratchet position of the catch is reproduced here, FIG. 3 The motor vehicle latch branches in turn according to FIGS. 1 and 2, whereby the catch is illustrated in the position shortly before the pawl engages into the main ratchet position, and FIG. 4 the motor vehicle latch according to FIGS. 1 and 3, whereby the latch is reproduced in a main ratchet position of the pawl and thus in a closed state of the tailgate.

FIG. 1 reproduces a motor vehicle latch 1 and in particular a tailgate latch 1, in a top view and without a latch lid. The motor vehicle latch 1 has a catch 2, a pawl 3, a triggering lever 4 and an electrical drive 5. The following are furthermore apparent.

Switching means 6, 7, a latch housing 8 and a gearwheel 9 with a control contour 10. A wormgear 11 is arranged between the electrical drive 5, which is preferably an electromotor and the gearwheel 9, so that the gearwheel 9 can be electrically activated.

The open position of the catch 2 is reproduced in FIG. 1. By means of closure of a door or flap, the motor vehicle latch 1 is moved against a non-illustrated latch holder so that the catch accomplishes a movement in the direction of the arrow P in a counterclockwise direction. In the opening position, the pawl 3 is adjacent on the adjacency contour 12 of the catch. The pawl 3 preferably lies adjacent in a spring pre-tensioned manner against the catch 2, whereby the pawl 3 is accommodated around the axis 13 in a pivotable manner in the latch housing 8. The triggering lever 4 is also pivotably accommodated around the axis 13 in this exemplary embodiment and also lies adjacent on a contour of the catch 2. The adjacency contour of the triggering lever 4 on the catch 2 is located in the view illustrated in FIG. 1 behind the catch 2. The triggering lever 4 is also adjacent against the catch 2 in a spring pre-tensioned manner.

Figure 2:
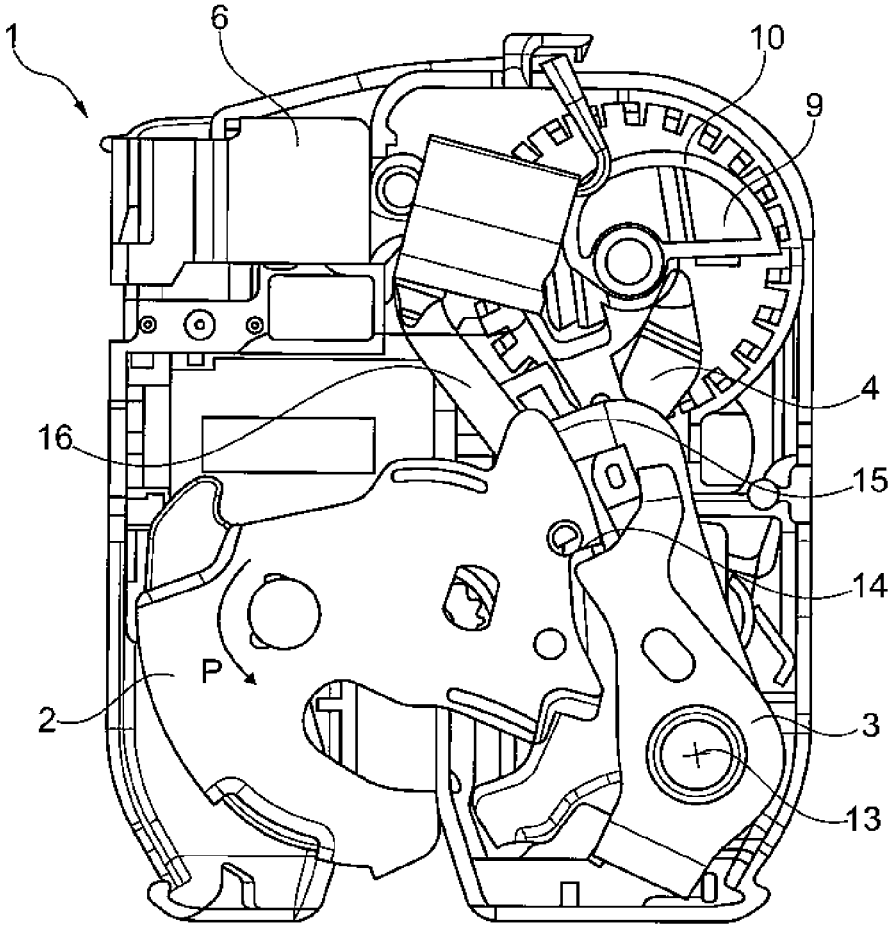

In FIG. 2, the motor vehicle latch 1 according to FIG. 1 is reproduced, whereby the catch 2 was pivoted in the direction of the arrow P in a counterclockwise direction and the pawl 3 engaged into a pre-ratchet 14 of the catch 2. The pawl 3 and the triggering lever 4 are conducted via a catch contour 15 on the catch 2 into the pre-ratchet positions illustrated in FIG. 2. It must be recorded that only the catch contour 15 is visible in FIG. 2 to conduct the pawl 3. An extension 16 is formed on the catch 3 which engages with the switching means 6 which can be a microswitch in particular. The switching means 6 can thus detect whether the catch 2 has engaged with the pawl 3. It can thus be detected by means of the extension 16 whether the locking mechanism is in a ratchet position. The pawl 3 and the triggering lever 4 have been pivoted in FIG. 2 in a clockwise direction around the axis 13. The triggering lever 4 engages with the control contour 10 of the gearwheel 9.

Figure 3:
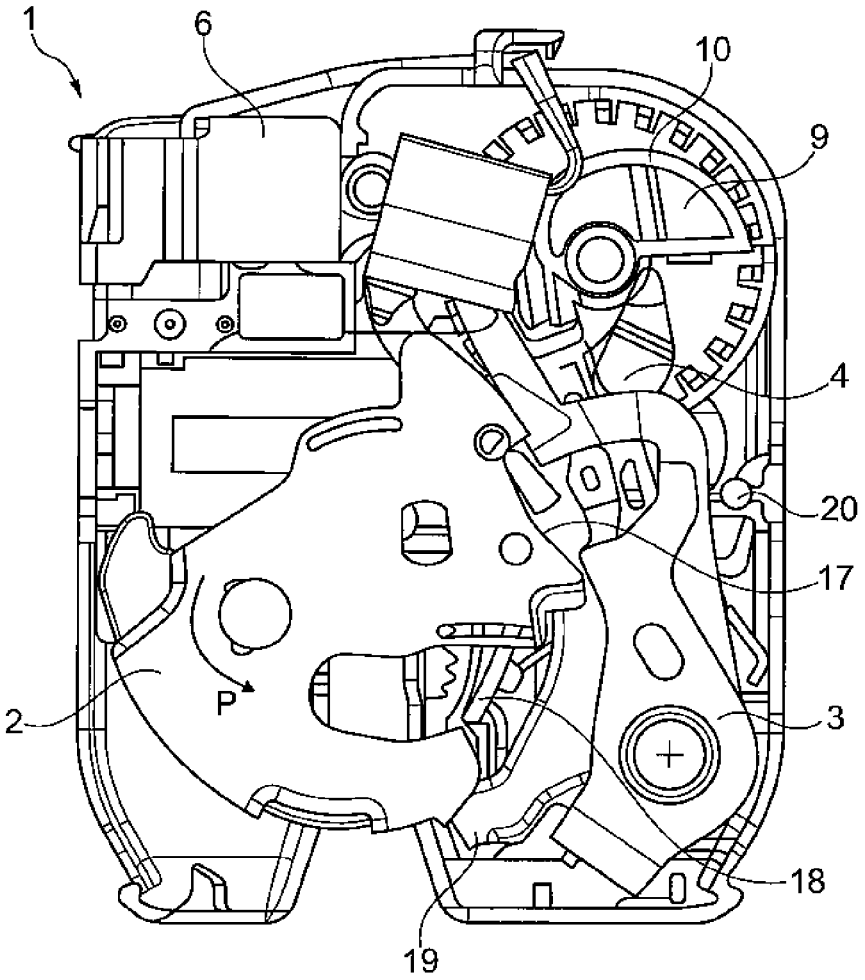

In FIG. 3, the motor vehicle latch 1 is reproduced in turn, whereby the catch 2 was pivoted in turn in the direction of the arrow P and the pawl 3 is conducted by means of the catch contour 17. The extension 16 is connected to the pawl 3 in a torque-proof manner so that the extension 16 is reproduced lifted from the switching means 6. As is also apparent from FIG. 3, the triggering lever 4 continues to lie adjacent on the control contour 10 of the gearwheel 9 and remains in its position which thus corresponds to the pre-ratchet position. Due to the partial conducting of the triggering lever 4 during closure or the rotational movement of the catch in the direction of the arrow P the triggering lever 4 is not further acted on with an impulse or moment by the catch 2. It is hereby ensured that the triggering lever 4 is not unduly greatly accelerated by excessively quick movement of the catch 2 and is possibly moved into a position which corresponds to the snow load function. The snow load lever 18 is also apparent in FIG. 3, whereby the snow load lever 18 engages with an end area 19 of the triggering lever 4 in the case of the snow load function. Independent conducting by means of the catch 2 is enabled by the separation of the pawl 3 and the triggering lever 4. In particular, by means of excessively rapid activation of the catch 2 only the pawl 3 can be accelerated after attainment of the pre-ratchet position, whereby the pivoting movement of the pawl is limited by the buffer 20 in the clockwise direction. Engagement of the snow load function during closure of the catch 2 is thus effectively prevented.

Figure 4:
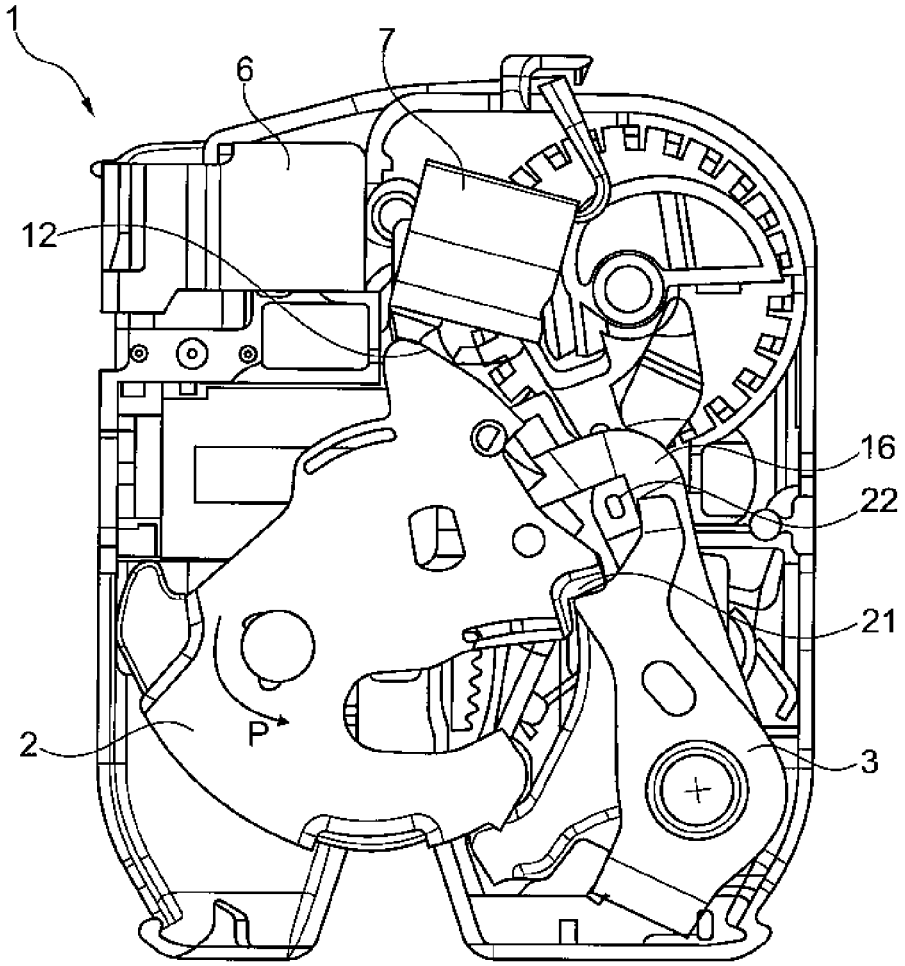

In FIG. 4 the motor vehicle latch 1 is reproduced in turn according to FIGS. 1 to 3. The closure position of the motor vehicle latch 1 is illustrated in which the catch 2 is located in a main ratchet position. The main ratchet 21 engages with the pawl 3. In turn, the extension 16 acts on the switching means 6, so that the position of the pawl 3 can be detected by means of the switching means 6. In addition, the catch 2 engages with the switching means 7 in the area of the adjacency contour 12, whereby a clear signal can be detected with which the closure state is electronically detected according to FIG. 4.

During closure of the motor vehicle latch 1 from the opening position according to FIG. 1 into the closure position according to FIG. 4 according to the invention the pawl 3 is led completely by means of the adjacency contour 12 and the catch contour 15, 17 until the pawl 3 engages into the main ratchet 21. The triggering lever 4 is only conducted partly along a contour which is not visible in FIGS. 1 to 4 from the opening position of the catch 2 into a pre-ratchet position. This ensures that the triggering lever 4 is not excessively accelerated and engages into the snow load lever 18. The triggering lever 4 lies adjacent during movement of the catch 2 from the pre-ratchet position into the main ratchet position on the control contour 10.

To open the locking mechanism the electrical drive 5 is activated, whereby the wormgear 11 is driven and the gearwheel 9 is moved. The gearwheel 9 is preferably moved in a counterclockwise direction so that the triggering lever 4 is moved and deflected along the control contour 10 namely deflected in a clockwise direction in such a way until the triggering lever 4 reaches the end position buffer 20, whereby on the one hand the end area 19 of the triggering lever 4 engages with the snow load lever 18 and whereby the pawl 3 is pivoted by means of the tappet 22 of the triggering lever 4 so far in a clockwise direction that the pawl 3 disengages with the catch 3. The catch 2 is released and can be moved into the opening position according to FIG. 1 in a spring-stressed manner and/or by means of the sealing pressure which acts on the motor vehicle latch 1.

LIST OF REFERENCE SYMBOLS

1 Motor vehicle latch, tailgate latch
2 Catch
3 Pawl
4 Triggering lever
5 Electrical drive
6, 7 Switching means
8 Latch housing
9 Gearwheel
10 Control contour
11 Worm gear
12 Adjacency contour
13 Axis
14 Pre-ratchet
15, 17 Catch contour
16 Extension
18 Snow load lever
19 End area
20 End position buffer
21 Main ratchet
22 Tappet
P Arrow

The invention claimed is:

1. A motor vehicle latch comprising a locking mechanism with a catch and a pawl, and a triggering lever, wherein the triggering lever causes the pawl to be disengaged from the catch, thereby causing the catch to be in an open position, wherein the motor vehicle latch has a storage lever function whereby after the triggering lever is activated to an activated position to disengage the pawl from the catch, the triggering lever is fixed in the activated position, wherein the catch is movable from the open position to a pre-ratchet position and from the pre-ratchet position to a main ratchet position, the catch being configured to move the triggering lever only during movement of the catch from the open position to a pre-ratchet position to prevent the catch from moving the triggering lever into an undefined position, the triggering lever being held in a same position during movement of the catch from the pre-ratchet position to the main ratchet position, the pawl being movable by the catch during movement of the catch from the open position to the pre-ratchet position and during movement of the catch from the pre-ratchet position to the main catch position.

2. The motor vehicle latch according to claim 1, wherein the pawl lies adjacent to the catch in an opening state of the motor vehicle latch corresponding to the open position of the catch.

3. The motor vehicle latch according to claim 1, wherein the catch has a pre-ratchet portion and a main ratchet portion, and the pawl and the triggering lever are movable from corresponding opening positions, in which the pawl is disengaged from the catch, to corresponding pre-ratchet positions by the catch.

4. The motor vehicle latch according to claim 1, wherein the pawl is movable into a main ratchet position by the catch, and the triggering lever is held in the same position corresponding to a pre-ratchet position of the pawl.

5. The motor vehicle latch according to claim 1, wherein the pawl has an extension, whereby at least a switching means is switched by the extension.

6. The motor vehicle latch according to claim 1, wherein the triggering lever has a tappet contour, and the pawl is deflected by the tappet contour to cause the pawl to be disengaged from the catch.

7. The motor vehicle latch according to claim 1, wherein the pawl and the triggering lever have a common pivoting axis.

8. The motor vehicle latch according to claim 1, wherein the triggering lever is deflected by an electrical drive including an electrically activated control contour.

9. The motor vehicle latch according to claim 1, wherein the pawl at least partly comprises metal and plastic.

10. The motor vehicle latch according to claim 1, wherein the triggering lever is made of plastic.

* * * * *